US005154127A

United States Patent [19]

Booth

[11] Patent Number: 5,154,127

[45] Date of Patent: Oct. 13, 1992

[54] FOLDING TABLE AND STORAGE STAND

[76] Inventor: Irving W. Booth, Jonathan Furniture Company, Airport Rd., Eagle River, Wis. 54521

[21] Appl. No.: 730,010

[22] Filed: Jul. 15, 1991

[51] Int. Cl.[5] ..... A47B 3/00

[52] U.S. Cl. ..... 108/115; 108/124; 108/16

[58] Field of Search ..... 108/115, 118, 119, 150, 108/124, 16; 211/13; 280/108.6, 188.7, 579

[56] References Cited

U.S. PATENT DOCUMENTS

| | | | |
|---|---|---|---|
| 66,813 | 7/1867 | Doty . | |
| D. 80,586 | 2/1930 | Thomas . | |
| 318,110 | 5/1885 | Harnish . | |
| 598,077 | 2/1898 | Comee . | |
| 899,383 | 9/1908 | Canniff | 108/124 |
| 1,046,247 | 12/1912 | Baerresen . | |
| 1,939,904 | 12/1933 | Koopman . | |
| 1,998,519 | 4/1935 | Odenwald | 108/124 |
| 2,055,007 | 9/1936 | Erpelding | 108/124 |
| 2,572,205 | 10/1951 | Shanks . | |
| 2,576,287 | 11/1951 | English . | |
| 2,591,797 | 4/1952 | Exline et al. | 108/115 X |
| 2,791,477 | 5/1957 | Wesbecher | 108/124 |
| 2,792,491 | 5/1957 | Rand . | |
| 3,162,149 | 12/1964 | Hansen . | |
| 3,270,693 | 9/1966 | Lind | 108/16 |
| 4,315,467 | 2/1982 | Vanderminden . | |
| 4,807,837 | 2/1989 | Gawlik et al. | 248/188.6 X |
| 4,955,873 | 9/1990 | Rajlevsky . | |

FOREIGN PATENT DOCUMENTS

| | | | |
|---|---|---|---|
| 2501983 | 9/1982 | France | 248/188.6 |
| 191882 | of 1923 | United Kingdom | 108/115 |

*Primary Examiner*—Jose V. Chen

*Attorney, Agent, or Firm*—Marshall, O'Toole, Gerstein, Murray & Bicknell

[57] ABSTRACT

A folding table comprising a rod, upper and lower rod braces attached to the ends of the rod and extending at substantially right angles to the rod, a spindle; upper and lower spindle braces attached to the ends of the spindle and extending at substantially right angles to the spindle; the rod extended through the spindle and being rotatable relative to the spindle between an open position wherein the rod braces extend substantially perpendicular with the spindle braces, and a folded position wherein the rod braces are in substantially the same plane as the spindle braces; and a table top hingedly connected to one of the upper braces. A stand for holding a plurality of the tables in the folded position comprises a vertical column, floor legs at the bottom of the column for supporting the column in a vertical position, and a pair of spaced supports attached to the column above the level of the floor, the supports being spaced to receive a spindle of one of the tables therebetween and the table top resting on the supports.

11 Claims, 3 Drawing Sheets

FOLDING TABLE AND STORAGE STAND

FIELD AND BACKGROUND OF THE INVENTION

This invention relates to furniture, and more particularly to a compact folding table and a storage stand for a number of such tables.

Many designs have been provided in the past and shown in prior patents relating to pieces of folding furniture. For example, the following listed patents show a number of designs of this general nature:

| NUMBER | PATENTEE | DATE |
|---|---|---|
| 4,955,873 | Rajlevsky | 09-11-90 |
| 4,315,467 | Venderminden | 02-16-82 |
| 3,162,149 | Hansen | 12-22-64 |
| 2,792,491 | Rand | 05-14-57 |
| 2,576,287 | English | 11-27-51 |
| 2,572,205 | Shanks | 10-23-51 |
| 1,939,904 | Koopman | 12-19-33 |
| 1,046,247 | Baerresen | 12-03-12 |
| Des. 80,586 | Thomas | 02-25-30 |
| 598,077 | Comee | 02-01-1898 |
| 318,110 | Harnish | 05-19-1885 |
| 66,813 | Doty | 07-16-1867 |

Typically such furniture is made foldable so that it will take up less space when not in use and may be stored more conveniently. In addition to being compactly folded for storage, such a piece of furniture should also be sturdy when opened for use, and have an attractive appearance when in use.

The Doty, Hansen, Thomas and Koopman patents show typical prior art folding tables, which include two pairs of upright legs. Each pair of legs are connected by horizontal braces and the braces are pivotably connected so that they may be folded together. A top is pivotably connected to one of the top braces so that the top may be folded between horizontal and vertical positions.

Some folding tables have been provided which include a single, centrally located spindle, which has a better design appearance and less interference with a user's legs. The English, Comee and Baerresen patents referred to above show examples of this design. A problem with these designs is that a number of movements are required to fold the various table parts. The Comee table, to overcome the above problem, has a gear and linkage type mechanism which, it would appear, is excessively complex and expensive to manufacture.

It is a general object of the present invention to provide an improved folding table design which overcomes the problems of the prior art and which has a good appearance.

SUMMARY OF THE INVENTION

A folding table constructed in accordance with this invention comprises a rod, upper and lower rod braces attached to the ends of said rod and extending at substantially right angles to said rod, a spindle;

upper and lower spindle braces attached to the ends of said spindle and extending at substantially right angles to said spindle;

said rod extending through said spindle and being rotatable relative to said spindle between an open position wherein said rod braces extend substantially perpendicular with said spindle braces, and a folded position wherein said rod braces are in substantially the same plane as said spindle braces; and a table top hingedly connected to one of said upper braces.

The invention further comprises a stand for holding a plurality of said tables in said folded position, said stand comprising a vertical column, floor legs at the bottom of said column for supporting said column in a vertical position, and a pair of spaced supports attached to said column above the level of the floor, said supports being spaced to receive a spindle of one of the tables therebetween and said table top resting on said supports.

BRIEF DESCRIPTION OF THE DRAWINGS

The invention will be better understood from the following detailed description taken in conjunction with the accompanying figures of the drawings, wherein.

DETAILED DESCRIPTION

Figure 2:
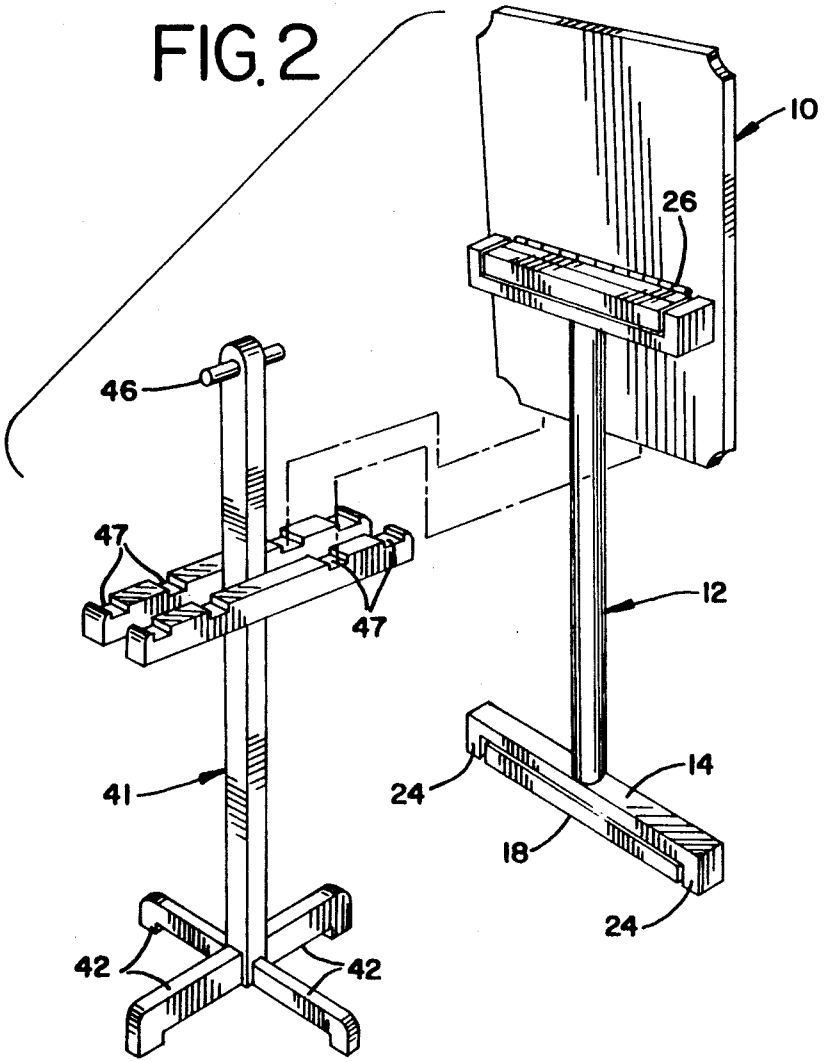
FIG. 2 is an exploded perspective view of the assembly of FIG. 1.

While the following detailed description and the claims include references to the location of parts relative to other parts in a figure of the drawings, and references to directions such as upper, lower, above or below, it will be understood that such references are used only to facilitate the description of the parts during normal use, since the apparatus described herein may have various orientations before and during use. Such reference should not be considered as limiting the scope of the invention or limiting the apparatus to any particular orientation during use.

A table constructed in accordance with this invention comprises a table top 10 and a support 11 for the top 10, and the support 11 includes first and second assemblies, one of which is rotatable relative to the other.

The first assembly (which may be considered stationary) includes a vertical hollow or tubular spindle 12, an upper cross member or brace 13, and a lower cross member or leg 14. The upper and lower cross members 13 and 14 extend horizontally in the same plane and are at a right angle with the axis of the spindle 12.

The second assembly (which may be considered movable) is rotatably mounted on the first assembly, and it includes a rod 16, an upper cross member or brace 17, and a lower cross member or leg 18. The spindle 12 has an axially located hole 19 formed through it, and the two cross members 13 and 14 have holes 21 through them which are aligned with the hole 19. The rod 16 extends through the holes 19 and 21, and the two cross members 17 and 18 are located above and below the cross members 13 and 14.

Figure 5:
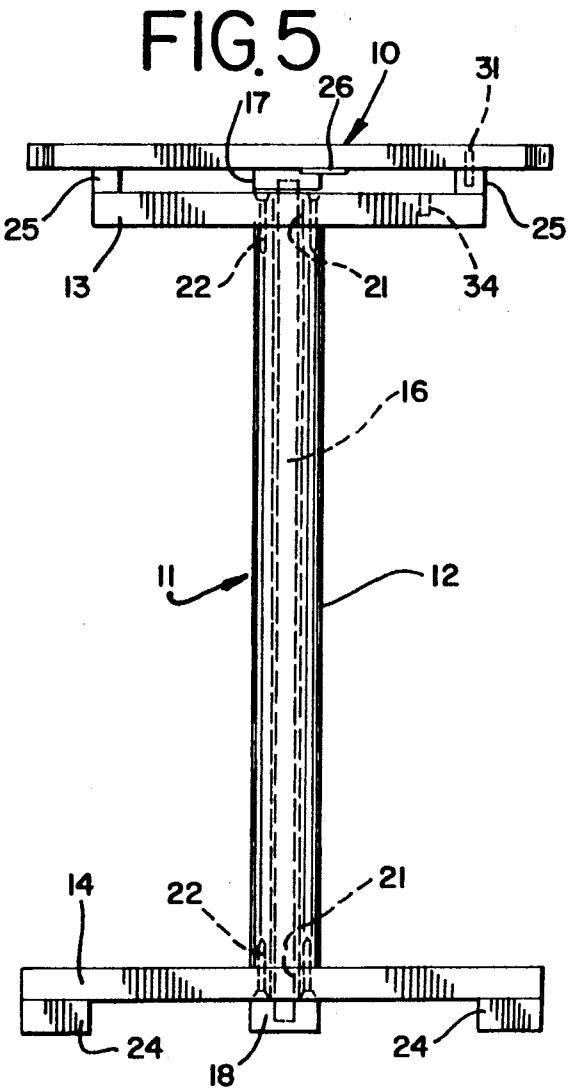
FIG. 5 is a front elevational view of the table in the open position.
Figure 8:
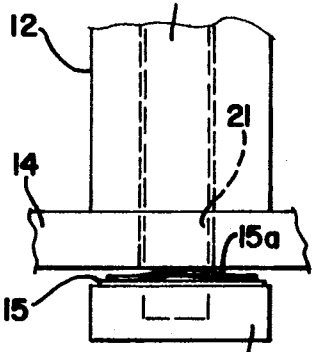
FIG. 8 is an enlarged fragmentary view of part of the table.

The cross members 13 and 14 are secured to the upper and lower ends of the spindle 12, such as by screws 22 (see FIG. 5) which extend through the members 13 and 14 and into the ends of the spindle. The ends of the rod 16 extend into holes formed in the cross members 17 and 18 and these parts are glued together. In addition, pins may be inserted through the sides of the members 17 and 18 and into the end portions of the rod 16 in order to firmly secure the parts together. With reference to FIG. 8, a washer 15 made of an antifriction material such as mylar is preferably placed between the parts 14 and 18 and another such washer is placed between the parts 3 and 17. Further, a wave washer or spring 15*a* is preferably provided between the parts 14 and 18 (or between the parts 13 and 17) to tighten the assembly.

While various designs may be used, the one shown, of course, being a specific example, the spindle 12 has a round cross section and the cross members 13, 14, 17 and 18 are generally rectangular. Blocks 24 having the thickness of the members 18 are fastened to the underside of the member 14, and the length of the member 18 is slightly less than the distance between the blocks 24, so that the member 18 nests under the member 14 and between the blocks 24 when the table is folded. Similarly, the member 13 has upper blocks 25 (FIG. 5) fastened to it and the member 17 nests in the space between the blocks 25.

Figure 4:
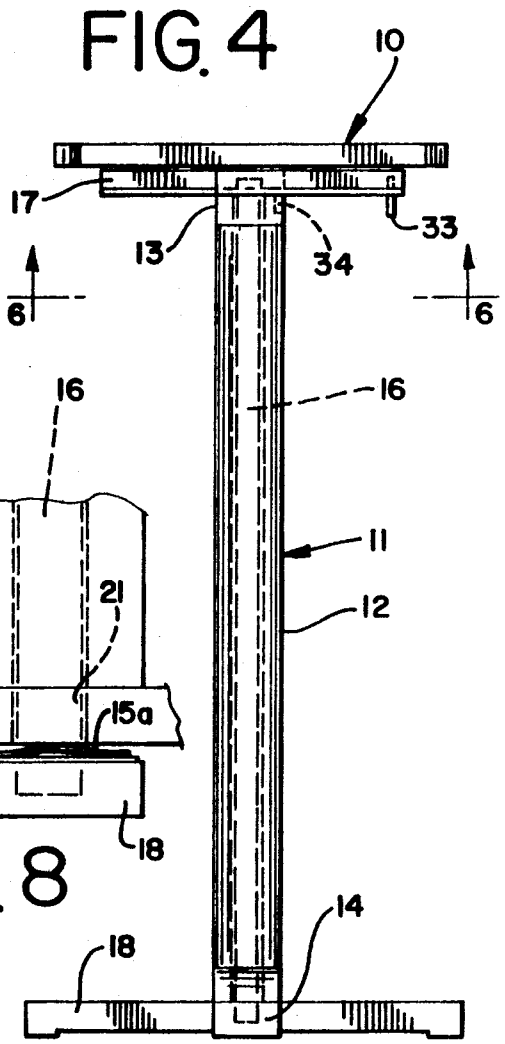
FIG. 4 is a side elevational view of the table in the open position.

Attached to the upperside of the cross member 17 by a hinge 26 is the top 10, which in this specific example is generally rectangular and flat. The top is movable between an open position (FIGS. 3 to 5) where it is in a generally horizontal plane, and a folded position (FIGS. 1 and 2) where the top is in a generally vertical plane. The hinge 26 may be a conventional type.

When in use, the table is moved to its open position wherein the top is substantially horizontal. The cross members 17 and 18 extend at right angles to the cross members 13 and 14, and the undersides of the member 18 and the blocks 24 rest on the floor. The uppersides of the member 17 and the blocks 25 engage the underside of and support the top 10. Since the members 13 and 14 form crosses relative to the members 17 and 18, respectively, the assembly is stable on the floor.

Figure 7:
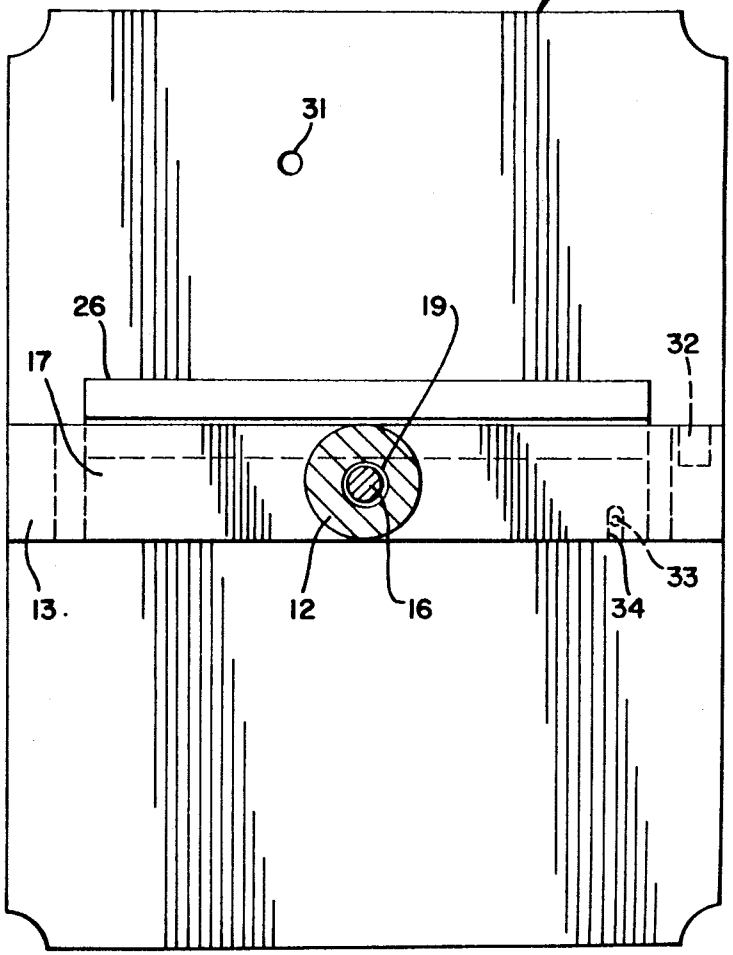
FIG. 7 is a view similar to FIG. 6 but showing the parts in the folded position.
Figure 6:
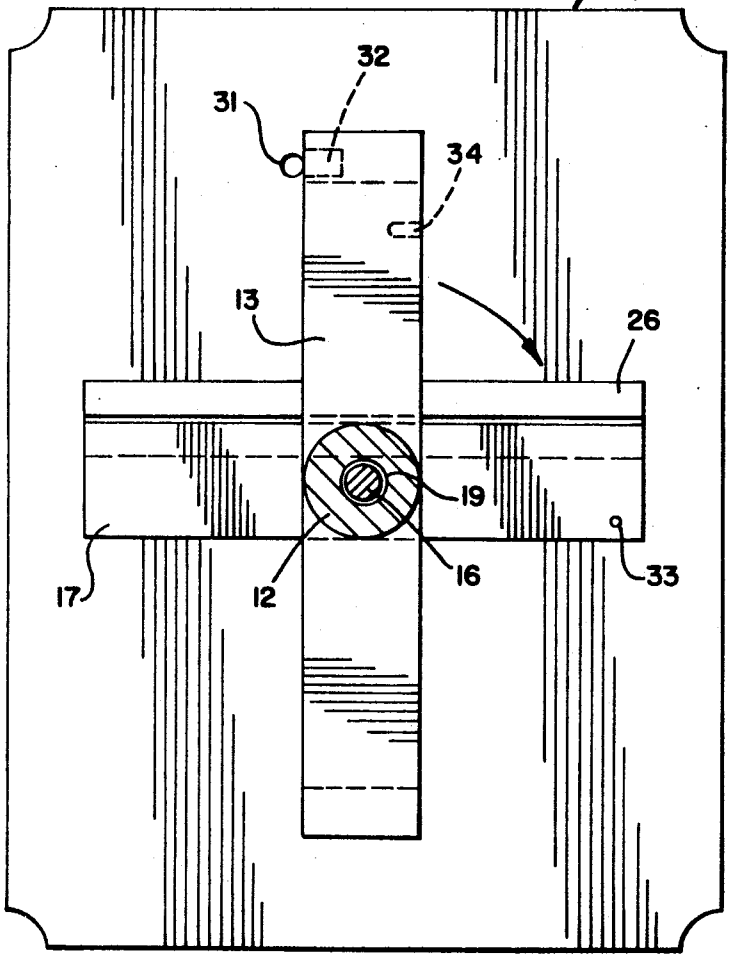
FIG. 6 is an enlarged sectional view taken on the line 6—6 of FIG. 4.

To fold the table for storage, the movable assembly is rotated 90° relative to the stationary assembly (see FIG. 6). This action places the four cross members 13, 14, 17 and 18 in a single plane which also includes the spindle 12 (see FIGS. 2 and 7). The hinge 26 axis extends parallel with the above plane, and the top is folded from the horizontal to the vertical position. When folded, the plane of the top is parallel with the plane of the cross members, thus forming a compact structure for storage.

Stops may also be provided to stop the rotation at the folded and open positions. An open stop pin 31 is secured to and extends downwardly from the underside of the top 10, at a location where it is engaged by one of the blocks 25 when the assembly is moved to the open position. A magnet 32 may be fastened to the block 25 and attached to the metal pin 31 for releasably holding the table in the open position. A folded position stop pin 33 is attached to and extends downwardly from the cross member 17, and it engages the member 13 when the assembly is rotated to the folded position. A slot 34 is formed in the adjoining side of the cross member 13 and receives the pin 33 when the parts are folded.

Figure 1:
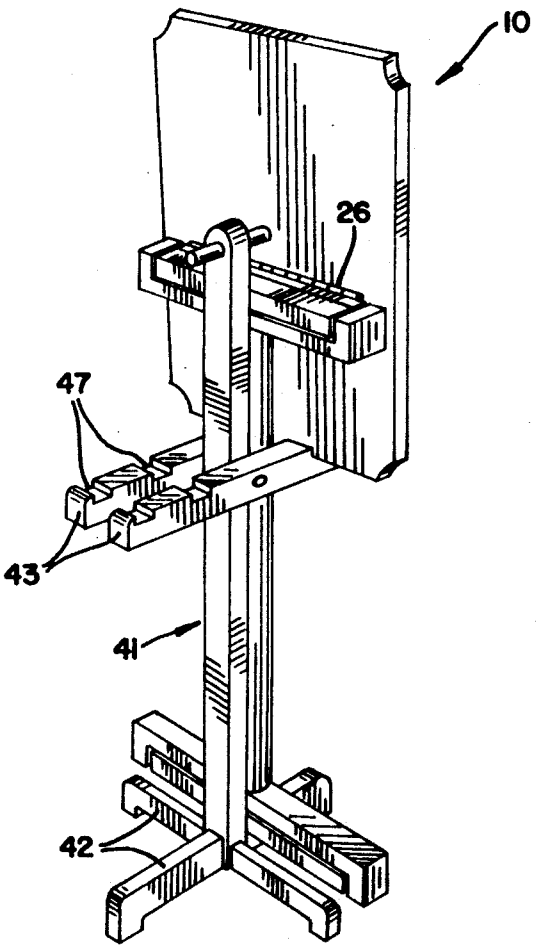
FIG. 1 is a perspective view of a folded table and stand assembly in accordance with the invention.
Figure 3:
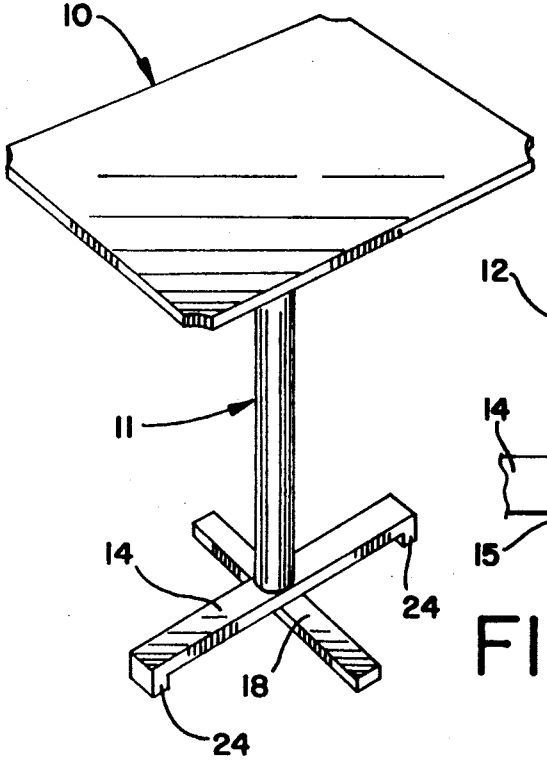
FIG. 3 is a perspective view of the table in the open position.

FIGS. 1 and 2 show a stand or rack which, in this specific example, holds four folded tables. The stand includes a vertical column 41 and four legs 42 secured to the lower end thereof, for supporting the column on the floor. Two spaced apart horizontal support bars 43 are secured to opposite sides of the column 41 by, for example, glue and screws. At the upper end of the column 41 is preferably provided a handle formed, in this example, by a laterally extending pin 46.

To store a table on the stand, the table is, of course, first moved to its folded position. The spacing between the two bars 43 is slightly greater than the width of the table spindle 12, and the spindle is inserted into this space. The lower edge of the table top rests on the two bars 43, and the height of the bars 43 above the legs 42 is such that the lower side of the cross member 18 is slightly above the legs 42. Means is preferably provided on the bars 43 to hold the table in place, and in this instance notches 47 are formed on the upper sides of the bars 43. Thus, when stored the lower edge of each table rests in a notch 47 and the top 10 is thereby prevented from sliding on the bars. In the present example, the stand has four notches for receiving four tables.

It will be apparent from the foregoing that a novel and useful apparatus is provided. The table, when opened for use, is sturdy and stable because the cross members firmly support the top. The table includes only a single centrally located spindle, rather than a plurality of legs as in prior art tables, and therefore the table does not have parts which interfere with placement close to a user's legs or to a couch, for example. A table having only a single spindle may be positioned close to a couch with the top extending over the side of the couch. Further, the single spindle presents a neater design appearance than does a table with numerous legs. The table may easily be unfolded simply by turning the top to the horizontal position, holding the top with one hand, and rotating the spindle 90° with the other hand or vice versa. The stand or rack holds a plurality of folded tables which are hung in parallel vertical planes. The lower edges of the tables are held in place on the bars so that the tables will not slide on the bars when the stand is carried about.

What is claimed is:

1. A foldable table comprising:

a) a spindle having a hole formed through it;

b) a rod extending through said hole and rotatable relative to said spindle;

c) first upper and first lower cross members each having a top side and a bottom side secured to the ends of said spindle;

d) second upper and second lower cross members each having a top side and a bottom side secured to the ends of said rod and rotatable with said rod relative to said first upper and first lower cross members, said top sides of said first and second upper cross members extending substantially horizontally in an upper plane and said bottom sides of said first and second lower cross members extending substantially horizontally in a lower plane, said bottom side of said second upper cross member being above said bottom side of said first upper cross member and said top side of said second lower cross member being below said top side of said first lower cross member; and e) a top hingedly attached to one of said upper cross members.

2. A foldable table as set forth in claim 1, wherein the lower surfaces of said first and second lower cross members are substantially in the same plane.

3. A foldable table as set forth in claim 1, wherein the upper surfaces of said first and second upper cross members are substantially in the same plane and support said top.

4. A foldable table as set forth in claim 1, and further including an open position stop connected between said top and one of said upper cross members.

5. A foldable table as set forth in claim 1, and further including a closed position stop connected between said upper cross members.

6. A foldable table as set forth in claim 1, wherein said first upper and first lower cross members are rotatable between open and folded positions relative to said second upper and second lower cross members, and one of said upper cross members is substantially straight, and the other of said upper cross members is substantially U-shaped and receives said one of said upper cross members in the opening formed by said U-shape when in said folded position.

7. A foldable table as set forth in claim 1, and further including means between adjacent cross members for facilitating said rotatable movement.

8. A stand for a foldable table, the table including a single vertical spindle and a top which extends substantially vertically when said table is folded, said stand comprising a substantially vertical column, legs fastened to the lower end of said column for supporting said column on a supporting surface, two supports secured to said column above said legs, said supports being secured to opposite sides of said column and spaced apart and extending substantially horizontally in opposite directions from said column, the spacing between said supports being parallel with respect to each other and on opposite sides of said column, and table engaging means on said supports.

9. A stand as set forth in claim 8, wherein said table engaging means comprises at least one notch in each of said supports, said notches being aligned.

10. An assembly of a foldable table and a stand for holding one or more of said tables when folded, said table comprising:

a) a spindle having a hole formed through it;

b) a rod extending through said hole and rotatable relative to said spindle;

c) first upper and first lower cross members secured to the ends of said spindle;

d) second upper and second lower cross members secured to the ends of said rod and rotatable with said rod relative to said first upper and first lower cross members; and e) a top hingedly attached to one of said upper cross members and movable between a generally horizontal position and a generally vertical folded position, and said top having a lower edge when in said folded position which is a first distance above a supporting surface for the table;

and said stand comprising:

f) a substantially vertical column;

g) legs fastened to the lower end of said column for supporting said column; and h) two supports secured to said column at a distance above said legs which is at least as great as said first distance, said supports being spaced apart and extending substantially horizontally, the spacing between said supports being sufficient to receive said spindle between said supports, and table engaging means on said supports for engaging said lower edged of said top of said table when in said folded position.

11. An assembly as set forth in claim 10, wherein said table engaging means comprises a notch in said supports for receiving said lower edge of said top.

* * * * *